United States Patent [19]

Schwing

[11] Patent Number: 4,473,132

[45] Date of Patent: Sep. 25, 1984

[54] FIRE ESCAPE MECHANISM

[76] Inventor: Robert F. Schwing, 419 Genesee St., Trenton, N.J. 08611

[21] Appl. No.: 324,844

[22] Filed: Nov. 25, 1981

[51] Int. Cl.[3] ..... B63C 1/2

[52] U.S. Cl. ..... 182/233; 182/238

[58] Field of Search ..... 182/70, 238, 73–76, 182/71, 72, 3, 233; 187/3

[56] References Cited

U.S. PATENT DOCUMENTS

| | | | |
|---|---|---|---|
| 1,233,540 | 7/1917 | Astarita | 182/3 |
| 1,528,803 | 3/1925 | Tock | 182/70 |
| 2,502,896 | 4/1950 | Sherbrook | 182/238 |
| 3,066,761 | 12/1962 | Behrens | 187/3 |
| 3,085,655 | 4/1963 | Van Dyk | 187/3 |
| 4,194,257 | 3/1980 | Martin | 182/3 |
| 4,327,818 | 5/1982 | Tepsa | 182/238 |

FOREIGN PATENT DOCUMENTS

| | | | |
|---|---|---|---|
| 640311 | 4/1962 | Canada | 188/65.1 |
| 12958 | 8/1889 | United Kingdom | 182/71 |

*Primary Examiner*—R. P. Machado
*Assistant Examiner*—Alvin Chin-Shue
*Attorney, Agent, or Firm*—Daniel E. Kramer

[57] ABSTRACT

A device and method for safely removing occupants of multi-story buildings under conditions of fire and catastrophe by allowing one occupant at a time to don a harness attached to the device and safely jump, with his rate of descent controlled so that he reaches the ground safely. The device has a rigid frame in which a rotatable shaft is positioned. On the shaft are mounted two drums. On each drum is wound enough cable to reach the ground from the height of installation of the device. Each drum has its cable wound in a direction of rotation opposite from that of its mate. A drag element acts on the shaft to limit the rotational velocity of the shaft, and thereby the rate of fall of the escaping occupant, to a speed which will not injure the occupant on contacting the earth. Only one user at a time will be able to occupy the apparatus since the cable end of the second cable is hidden under the first cable and is not accessible until the first cable has been completely unwound. A pair of elevator type tubular conduits are provided, each with a walk-in shuttle, to enclose each occupant on his descent and a keyway to prevent rotation of the occupant-containing shuttle during its descent and ascent.

3 Claims, 11 Drawing Figures

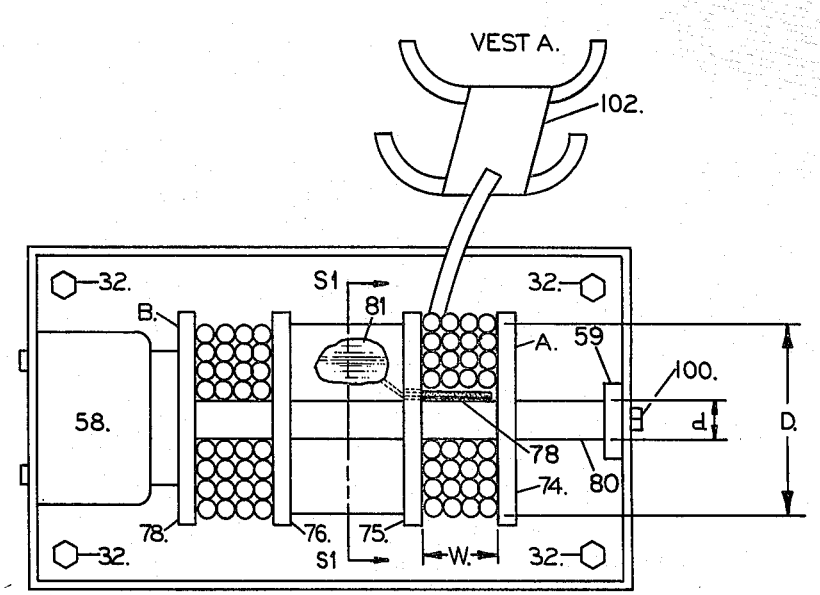
FIGURE 5
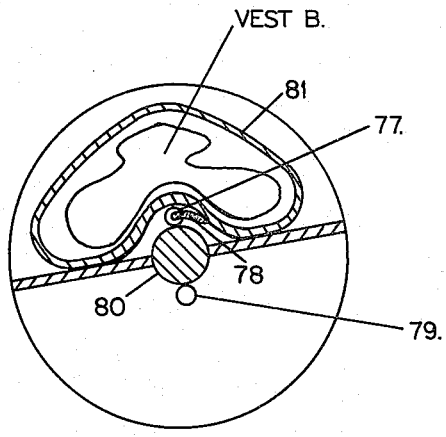
FIGURE 5-S1

FIRE ESCAPE MECHANISM

BACKGROUND OF THE INVENTION

1. Field of the Invention

This invention relates to apparatus for facilitating the escape of building occupants under conditions where normal means of egress are unusable. This invention further relates to an apparatus for lowering the building occupant on a wire fed from a rotating drum at decreasing velocities so that the final velocity attained by the occupant just prior to contacting the earth is sufficiently low to allow him to alight safely.

2. Prior Art

No prior art is known to the inventor relating to fire escape mechanisms of this type.

BRIEF SUMMARY OF THE INVENTION

The apparatus of the invention includes a frame intended to be anchored to a floor or a wall of a building having occupants. The frame contains a shaft, mounted on bearings, to provide relatively free rotation. The free rotation of the shaft is controlled by a device having a fixed element attached to the frame and a rotatingly resistive element attached to the shaft. The device is of the type whose resistance to rotation increases as the rotational velocity of the shaft increases. Mounted on the shaft are two pulleys or drums, each of which are rotationally fixed to the shaft so that the shaft and they must turn together. Each drum has wound on it a length of wire sufficient to reach from the apparatus to the ground, a distance varying with the elevation of the apparatus in the building. A first drum, the first to be used, has a vest exposed and ready for donning by the first occupant requiring its use. The wire wound on the second drum also has a vest attached to its end, but the vest is hidden in such a way that it can be accessed only after all the wire has been reeled off the first drum. In use, the building occupant secures a vest from the first drum, dons it, lowers himself over the edge of the building opening, and allows himself to fall free. As the wire unreels from the drum, its effective diameter decreases and its attempted speed increases, increasing the resistance of the speed controller, thereby reducing the velocity of the building occupant as he approaches ground level to a velocity safe for alighting. When the occupant is safely on the ground, he unfastens the vest and leaves the site of the building. The second occupant, still trapped in the building, now finds that the drums have come to rest and that the unreeling of the wire from the first drum has released the vest tied to the end of the wire wound on a second drum. He dons the vest and releases himself from the building aperture. As the second occupant falls, the wire wound on the second drum pays out while the rotational speed of the drum and consequently the rate of fall of the second occupant is controlled by the controller. As the second drum is forced to rotate by the weight of the second occupant pulling on the wire wound on drum 2, the forced rotation of the shaft causes the first drum to turn and the wire recently unwound from the first drum now to rewind. When the second occupant alights on the ground, the third occupant finds the first drum fully ready for use for his exit and the vest, having been returned from ground level to exit level, handy to his access.

BRIEF DESCRIPTION OF THE DRAWINGS

FIG. 5 is a front cross-sectional elevation of the apparatus showing the speed control as a hydraulic coupling, the two drums with the wire wound on each, and the vest.

FIG. 5-S1 shows a cross-section of the construction of FIG. 5, showing the containment for the secondary vest.

DETAILED DESCRIPTION OF THE INVENTION

Figure 1:
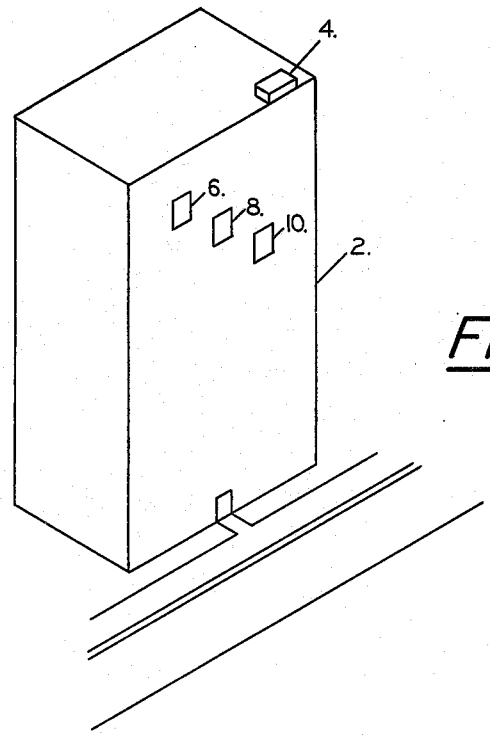
FIG. 1 shows an outline of a high rise building of a type in which the apparatus described herein can be used.

FIG. 1 is illustrative of the nature of buildings and locations within buildings in which the instant apparatus would be employed. High-rise building 2 has many windows among which the apparatus might be installed in corridor areas or in individual rooms having windows facing the outside, such as 6, 8 and 10, or in a roof position accessible by occupants of the upper stories who would make their way there in the event of a disaster and utilize the apparatus 4 to safely lower themselves to the street level.

Figure 2:
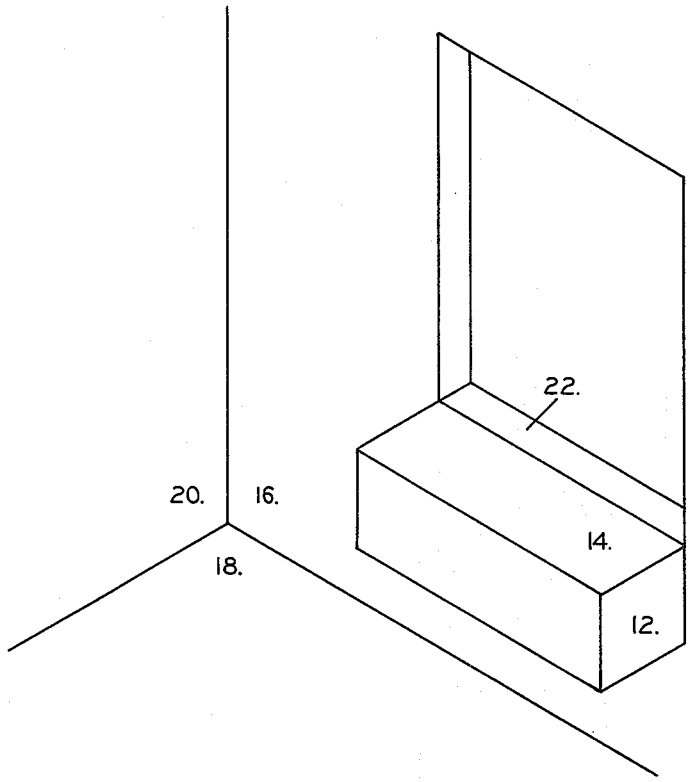
FIG. 2 shows the interior of the building at a window residing in an occupant's room or in a commonly accessed hallway where the apparatus is located at the lower periphery of the window.

FIG. 2 shows the interior of a room having a window facing the exterior of the building with exterior wall 16, window 22, floor 18, with the apparatus 12, secured to the outer wall 16 for operation in a manner that will be explained subsequently.

Figure 3:
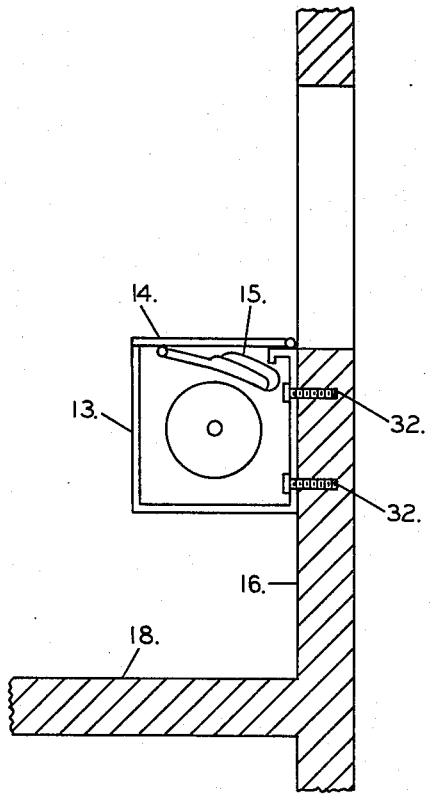
FIG. 3 is a cross-section of a portion of the building and the apparatus, showing the method of anchoring and a detail of the internal construction of the drum.
Figure 4:
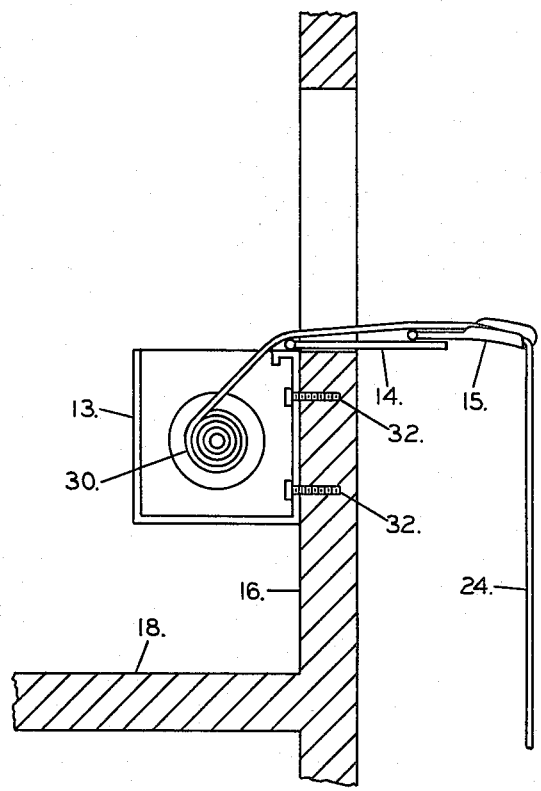
FIG. 4 is a second cross-sectional view of the building, showing in further detail construction of the apparatus.

FIG. 3 shows a cross-sectional view of the wall and apparatus of FIG. 2. Frame 13 is bolted by bolts 32 to the outer wall 16. Cover 14 provides a top closure for the apparatus with member 15, whose function will be later explained, hidden inside. In the operative mode of FIG. 4, cover 14 is folded up and outwardly and inner member 15 is further extended so that the cable 24, which is fed from the wound-up spool 30, will carry the occupant safely to the ground and keep the descending occupant clear of the building.

FIG. 5 is a plan view of the apparatus, showing shaft 80 mounted at one end on bearing 59, with square portion 100 protruding. On shaft 80 are mounted drum A and drum B, each containing a measured length of wire sufficient to reach from the elevation of the apparatus to the ground level. Drum A has a vest A attached to the loose end of its cable. This vest is located in an area that is readily accessible to the first occupant who opens cover 14. There is a vest B attached to the end of the cable wound on drum B, but this vest is hidden from view and secured by a flexible member 78 which is placed on shaft 80 at the root of drum A and is securely held in place by the cable which has been wound on drum A. Thus B is hidden from view in the space between flanges 75 and 76 of drums A and B respectively. The vest of drum B is locked and hidden in this way in order to preclude the possibility that a panicky occupant will attempt to don vest B and utilize it at the same time that the first occupant, wearing vest A, leaps from the window to safety. Fifty-eight (58) is a device capable of applying resistance to the rotation of shaft 80. Friction clutches of many types would, if adequately cooled, be suitable. It has been found that a fluid brake, similar in design to the fluid couplings found in automobile transmissions, provides the most effective performance. A cross-section of the apparatus in FIG. 5, taken in the portion between the two drums, identified by S-1, is shown in FIG. 5 S-1. Here, the vest B, is enclosed in a container 81. The container is securely held in its position between the two drums by a wire 78 attached to it which extends underneath the cable wound on drum A through hole 77. Only when the wire wound on drum A has been completely unwound, signifying that the occupant, wearing vest A, has reached the ground, may vest B be removed and donned by the next occupant to employ the device. The second occupant, now wearing vest B, will leap to safety from his window. In the course of his controlled fall the rotation of the shaft caused by the unwinding of cable from drum B will cause the cable previously unwound from drum A to be rewound on drum A and to return vest A to a position where it can be retrieved and redonned by a successive occupant eager and ready to escape using the means and apparatus of this invention.

Figure 6:
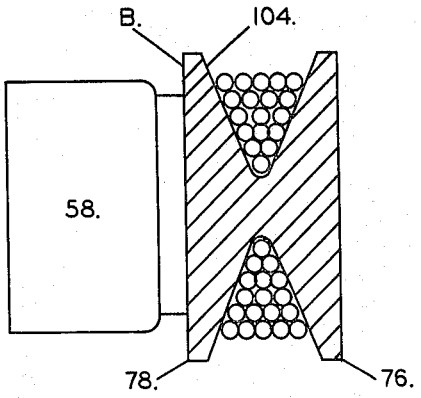
FIGS. 6 and 7 are cross-sections of two possible drum designs on which wire can be wound in order to achieve certain objectives in terms of the velocity profile of occupants leaving the apparatus and approaching the ground.
Figure 7:
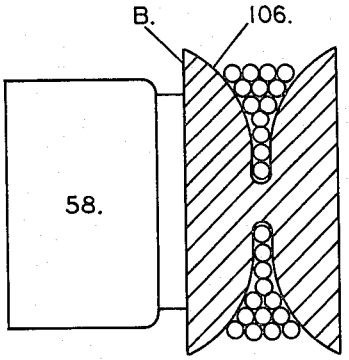

FIGS. 6 and 7 display contours which drums A and B can have for the purpose of achieving the desired velocity profiles of the occupants under various predetermined conditions. The profile of FIG. 6, having a concave outline, is most applicable to a high-rise building where the vested occupant must be allowed to fall at high velocity under relatively low resistance from speed control 58 until most of the cable has been removed from the drum. As the effective diameter of the drum decreases, its rotational speed increases, increasing thereby the effective resistance to rotation of speed control 58. This increased resistance to rotation slows the fall of the occupant to that rate at which he can safely alight when he has reached the ground.

In FIG. 7 the contour of the drum B has been shaped in a convex fashion for buildings having a small height. With a convex shape, the low torque, high velocity fall zone is relatively brief and the final slow fall, high torque portion is arrived at quickly, just before the termination of the feed-out of the cable wrapped on the drum 106.

Figure 8:
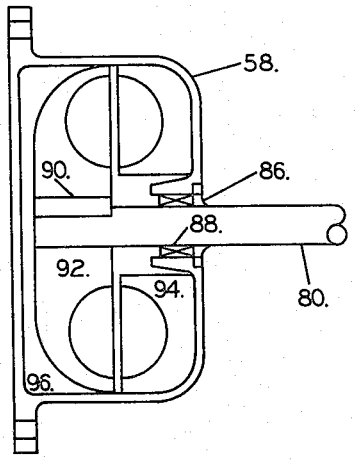
FIG. 8 is a cross-section of a typical hydraulic coupling which is used on an apparatus of this type.

FIG. 8 is a cross-section of a hydraulic coupling which absorbs energy and resists rotational motion so that the rotational velocity of shaft 80 is controlled with respect to the angular force imposed on it by the weight of the escaping occupant. Housing 58 contains a viscous fluid, such as an oil; shaft 80 drives impellers 94. Stationary vanes 92 are secured to the base 96. Shaft seal 86 ensures the retention of fluid 90 within the assembly. Bearing 88 supports the shaft 57. The stationary vanes 92 resist the rotational motion of impellers 94, causing the shaft to rotate at that speed which will safely control an occupant's descent. In FIGS. 6 and 7 the cross-sections of the drums are arranged to allow one, or relatively few, turns per layer of winding at the smallest diameter of the drum, and to allow substantially a greater number of turns per layer of winding near the periphery of the drum.

Figure 9:
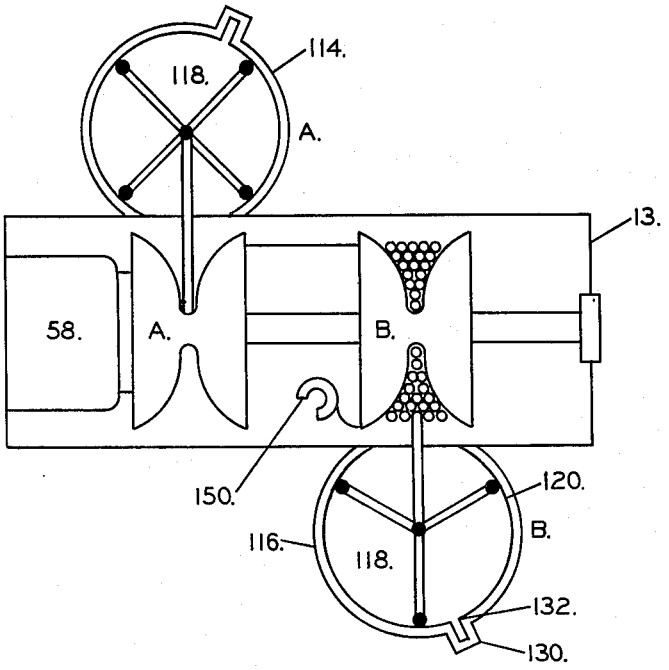
FIG. 9 shows the apparatus mounted inside the building with two tubular enclosures, each containing a cage for the use of escaping occupants.
Figure 10:
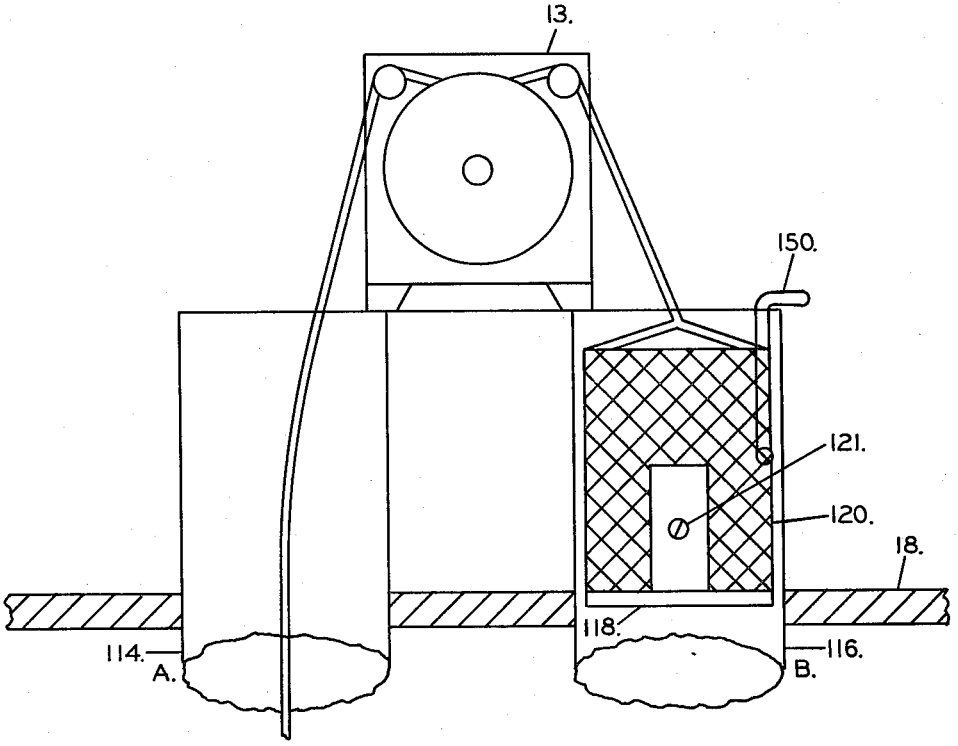
FIG. 10 is a cross-sectional view in elevation of the apparatus and shafts of FIG. 9 with the apparatus mounted at ceiling level and the cages positioned so an occupant can walk into them.

FIG. 9 shows a plan view and FIG. 10 a view in elevation of a construction where the apparatus and its frame 13 is positioned over a pair of vertical, cylindrical conduits within which are intended to travel platform 118. The platform 118, positioned in conduit A, is connected to the wire on drum A, and the platform 118 in conduit B is connected to the wire wound on drum B. Both platforms 118 have a protruding key 132 which mates loosely with a slot 130 in the conduit. The purpose of this key and slot is to prevent rotation of platform 118 as it is traversing the conduit in its controlled descent bearing an occupant or in its unloaded ascent. Initially platform 118 of conduit B is at floor level to provide easy access to the first escaping occupant. Platform 118 of conduit A at the same time has its wire fully paid out so that drum A is empty and positioned at ground or escape level. When a first occupant desires to use the escape mechanism, he simply opens the door 121, steps on to platform 118, and within releases hook 150. The platform 118, its occupant protected by enclosure 120, drops at controlled speed through conduit B to safety. Simultaneously, the platform 118 of conduit A is raised to the level of floor 118 by the winding up of its wire on drum A as platform 118 of conduit B descends to the ground or escape level.

A second occupant then steps on to the empty platform of conduit A and himself descends to safety, thereby raising the platform of conduit B to its initial position for subsequent use by a succession of occupants.

It will be apparent to those of ordinary skill in the art that various changes may be made in the invention without departing from the spirit in the scope thereof and therefore it is my intention that the invention not be limited by that which is shown in the drawings or described in the specification but only as indicated in the following claims.

I claim:

1. A building escape mechanism comprising a frame; a shaft rotatably mounted within the frame; drag means for limiting the rotational speed of the shaft; first drum and second drum, both rigidly mounted on the shaft so that any angular motion of a drum is accompanied by an equal angular motion of the other drum and shaft; a first flexible member having length L wound on the first drum and fastened thereto at one end; a second flexible member having length L wound on the second drum and fastened thereto at one end; a first accessible occupant-supporting structure attached to the free end of the first member; a second, initially inaccessible occupant-supporting structure attached to the free end of the second member; and means secured by the windings of the first member on the first drum for causing said second structure to rotate with the drums and for restricting access to the second structure until the first member windings on the first drum, securing the second occupant-supporting structure, have been unwound.

2. An escape mechanism as in claim 1 where the opposite sides of a drum are shaped so that they are close together near the shaft, allowing relatively few turns per layer of winding, and far apart near the drum periphery, allowing relatively many turns per layer of winding.

3. An escape mechanism as in claim 1 where the drag means is a hydraulic coupling.

* * * * *